US005603665A

United States Patent [19]

Bryant

[11] Patent Number: 5,603,665

[45] Date of Patent: Feb. 18, 1997

[54] GOLF PUTTER TRAINING DEVICE

[76] Inventor: Judy Bryant, 16 Maple St., Arlington, Mass. 02174

[21] Appl. No.: 629,987

[22] Filed: Apr. 8, 1996

Related U.S. Application Data

[63] Continuation-in-part of Ser. No. 508,925, Jul. 28, 1995, Pat. No. 5,544,887.

[51] Int. Cl.[6] ..... A63B 69/36

[52] U.S. Cl. ..... 473/230; 273/DIG. 30

[58] Field of Search ..... 473/230, 328; 273/DIG. 30

[56] References Cited

U.S. PATENT DOCUMENTS

| | | | |
|---|---|---|---|
| 2,255,332 | 9/1941 | Russell | 473/328 |
| 2,426,274 | 8/1947 | Kramer | 473/230 |
| 3,680,868 | 8/1972 | Jacob | 473/328 |
| 4,535,992 | 8/1985 | Slagle | 473/230 |
| 5,411,263 | 5/1995 | Schmidt et al. | 473/313 |
| 5,544,887 | 8/1996 | Bryant | 473/230 |

*Primary Examiner*—George J. Marlo

*Attorney, Agent, or Firm*—Weingarten, Schurgin, Gagnebin & Hayes LLP

[57] ABSTRACT

A golf putter training device that includes a clip for removeably attaching a bracket having a roller mounted therein. The clip includes at least one finger to hold the bracket in place during a practice putt, and allows the bracket to be easily removed for the final putt. The bracket may include resilient washers located between the bracket arms and the ends of the roller, and the roller may include a polymer coating on each end. A misaligned putting stroke will result in a coated end of the roller being forced against one of the washers, thereby generating friction and providing directional feedback to the user.

9 Claims, 3 Drawing Sheets

GOLF PUTTER TRAINING DEVICE

CROSS-REFERENCE TO RELATED APPLICATIONS

This application is a continuation-in-part of U.S. application Ser. No. 08/508,925, filed Jul. 28, 1995, now U.S. Pat. No. 5,544,887.

FIELD OF THE INVENTION

This invention relates to golf putters, and more particularly to golf putters incorporating a removable training device.

BACKGROUND OF THE INVENTION

Developing a proper putting stroke requires hours of practice and patience. Golfers at both beginning and intermediate skill levels are advised to learn the proper putting stroke techniques in order to establish good form and lower their golf scores.

Proper putting technique requires maintaining the club head perpendicular to the desired line of travel of the ball throughout the putting stroke. Deviations from perpendicular head contact result in the ball veering off to one side or the other. In order to achieve the proper stroke, beginning golfers are instructed to move their arms in a pendulum-like motion and to maintain their hands in a fixed position holding the club head perpendicular to the line of sight to the cup. In order to more easily learn this stroke technique, U.S. Pat. No. 5,411,263 to Schmidt et al. shows a putter having a control rail projecting downwardly from a bottom wall to engage the turf and stabilize the head against twist during the head downward placement. However, such a design does not provide feedback to the golfer to alert him that his stroke is not perfectly perpendicular with the desired line of travel of the ball. In addition, the rail shown by Schmidt et al. is a permanent fixture of the putter head and may not be removed once proper stroke technique has been mastered.

SUMMARY OF THE INVENTION

The present invention is directed to a golf putter training device which may be used on the golf course or in the home. The invention features a mounting clip attached to the bottom surface of a golf putter head which can accommodate a U-shaped bracket with a roller mounted therein. The U-shaped bracket that holds the roller is removeably insertable within fingers that form part of the mounting clip to position the roller underneath the club head during a putt.

The mounting clip includes at least one finger to hold the U-shaped bracket. The mounting clip of the training device is held onto the bottom face of the club head by any adhesive such as glue, double sided tape, "VELCRO", welding, screws or other attachment means known in the art. The bracket holds a roller which rolls along the ground during a putting stroke. In one embodiment, the bracket also includes a resilient washer positioned between ends of the roller and the downward extending arms of the bracket, and a polymer coating on each end of the roller. During a putt the washers and the coated ends of the roller interact to provide stronger directional feedback to the user during a misaligned putting stroke.

In use, the training device of the invention provides feedback to the user to indicate that the putting stroke is not perpendicular with the desired line of travel of the ball. The frictional feedback allows the user to correct the misalignment through practice, and results in a perfectly perpendicular club face during putting and better putting technique.

DESCRIPTION OF THE DRAWINGS

The invention will be more fully understood from the following detailed description taken in conjunction with the accompanying drawings in which.

DETAILED DESCRIPTION OF THE INVENTION

Figure 1:
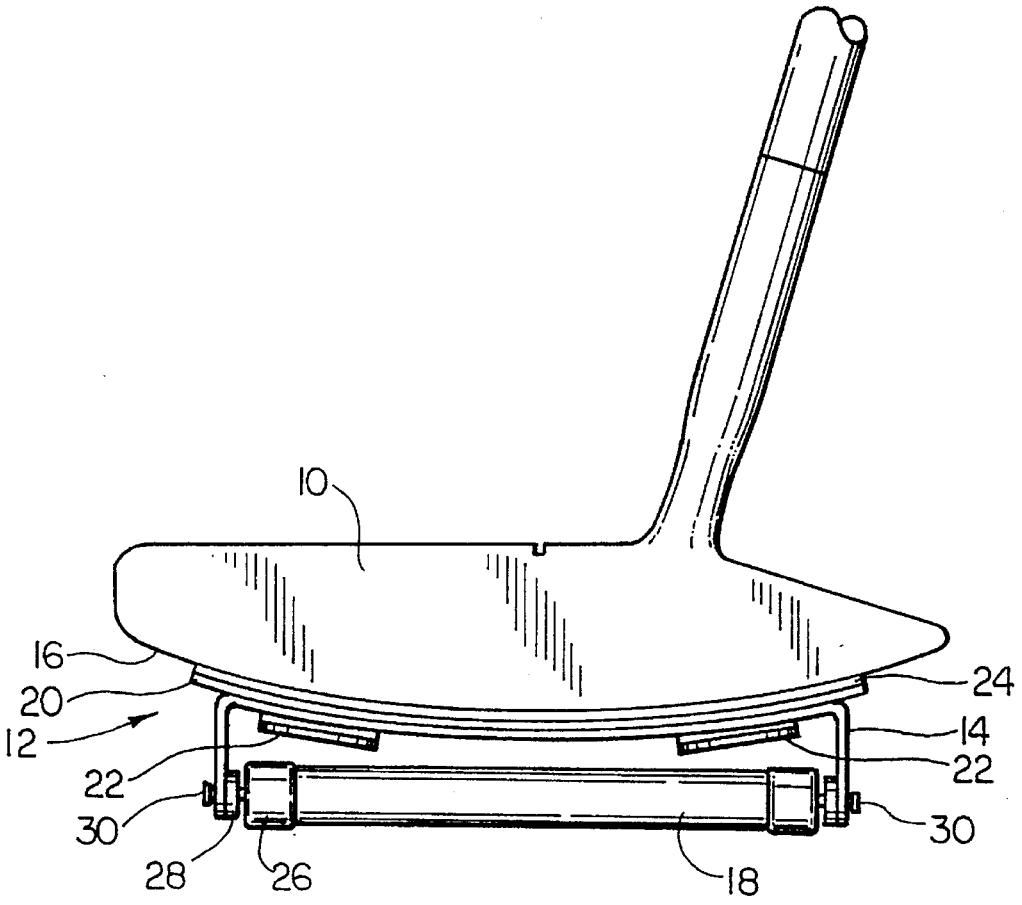
FIG. 1 is a side view of a putter head incorporating the training device of the invention.
Figure 2:
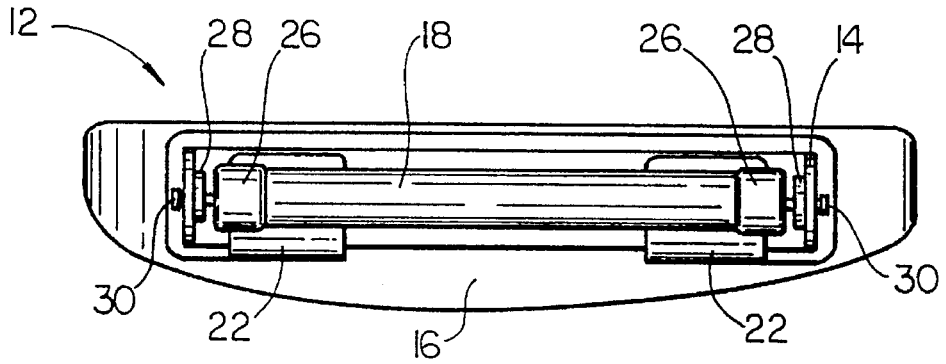
FIG. 2 is a bottom view of a putter head incorporating the training device of the invention.

FIGS. 1 and 2 show side and bottom views, respectively, of a club head 10 incorporating the training device 12 of the invention. The training device 12 includes a U-shaped bracket 14 inserted within a mounting clip 20 which is, in turn, mounted on the lower face 16 of the club head. The roller 18 is held within the bracket 14 by a pair of mounting pins 30, located on each end of the roller. The mounting pins 30 insert into holes on opposite ends of the bracket 14 and permit the roller 18 to rotate freely when mounted in the bracket 14. The roller 18 may be fabricated of any lightweight, durable material such as hollow brass, plastic, graphite and other suitable materials. Use of lightweight materials in the design and fabrication of the training device is desirable to minimize added weight and maintain the "feel" of the putter while the training device is in use. Use of a roller 18 of at least approximately 70% of the length of the club head is desirable in order to provide adequate feedback to indicate whether the user's stroke is out of alignment with the intended direction of travel of the ball, but there is no specific limit on its length. Further, the training device is attached to the club head such that the center of the roller is aligned with the center ("sweet spot") of the club head for maximum effectiveness and control.

Figure 3:
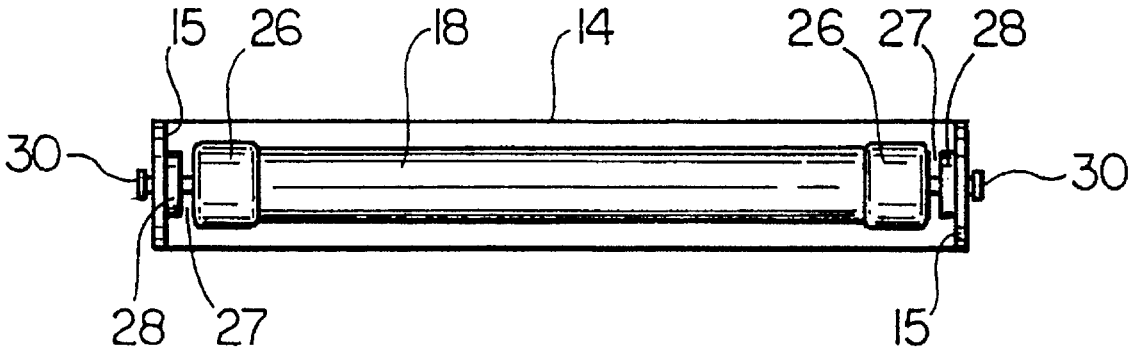
FIG. 3 is a bottom view of the roller and U-shaped bracket of the invention.
Figure 4:
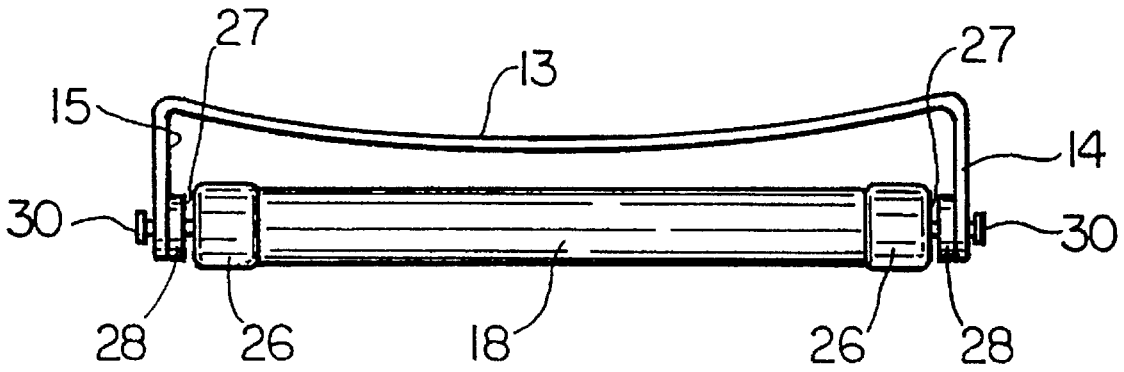
FIG. 4 is a side view of the roller and U-shaped bracket.

In a particular embodiment, illustrated in FIGS. 3 and 4, washers 28 are installed on the mounting pins 30 between ends of the roller 18 and the inside face 15 of the arms 14 of the bracket. The washers may be fabricated from any soft, resilient material such as open-celled foam, plastic, rubber, or the like. Preferably, the ends of the roller 26 are coated with a latex, rubber or other soft polymer material that is capable of interacting with the washer and generating friction. A small gap 27 between the washers 28 and the-ends of the roller 26 permits the roller 18 to rotate freely during a properly aligned putting stroke. However, if the putting stroke is not properly aligned, the roller 18 will traverse the gap 27 and the end of the roller 26 will be brought into frictional contact with the washer 28. The friction generated by the interaction of the washer 28 and the coating on the end of the roller 26 is transmitted up the shaft and alerts the user that the putting stroke is misaligned. Such an arrangement provides for a higher degree of feedback than might be felt with an uncoated end of a roller engaging the washer or, if the washers were not implemented, the arm of the bracket 14.

Figure 5:
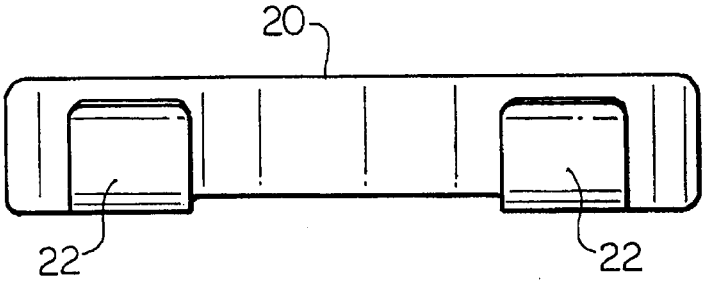
FIG. 5 is a bottom view of the mounting clip of the invention.

Referring now to FIG. 5, a bottom view of the mounting clip 20 is shown. A preferred embodiment, illustrated in FIG. 5, shows two fingers 22 for securing the bracket 14 within the clip 20. While two fingers are shown in the illustrated embodiment, it will be appreciated that any number of fingers could be implemented. Alternatively, a single finger equivalent to the length of the clip may be used.

Figure 6:
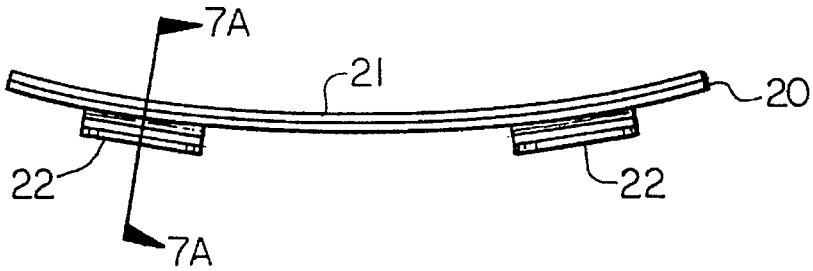
FIG. 6 is a side view of the mounting clip of the invention.

FIG. 6 shows a side view of the mounting clip 20. As shown in FIG. 6, the upper surface 21 of the clip 22 is contoured to match the bottom surface of the putter head 16. Thus, when the clip 22 is attached to the club head 10, continuous contact is made between the upper surface 21 and the club head 10. The mounting clip may be attached to the bottom surface of the club head 16 by an adhesive, double sided tape, interlocking fibers such as "VELCRO" or any other manner of attaching one device surface to another.

Figure 7:
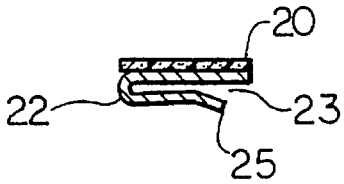
FIG. 7 is a cross-sectional end view of the mounting clip taken across line 7A—7A' of FIG. 6.

FIG. 7 shows a cross-sectional view of a finger 22 of the clip 20 along line 7–7A' of FIG. 6. The finger 22 has an opening 23 of sufficient size to provide tension to the bracket 14 when the bracket is inserted into the finger 22. The finger is generally J-shaped, with a flared lip 25 which serves to facilitate insertion of the bracket 14. Once the bracket 14 is inserted into the finger 22, finger 22 provides tension to maintain the bracket 14 in the proper position within clip 20.

Referring again to FIG. 1, the face of the bracket 13 that confronts the mounting clip 20 is shaped to conform to the curvature of the mounting clip 20. The bracket 14 and mounting clip 20 are fabricated of flexible materials, such as spring steel, plastic, or other suitable material, so that the training device may be attached to the bottom surface of the club head 16 as described above. Generally, a preferred putter is selected for its comfort and feel, and accommodation may be made along the bottom surface of the putter head 16 to accept the training device 12 of the invention. The mounting clip 20 may be either fixedly attached to the putter head 10, with the bracket and roller assembly 12 inserted and removed as required, or the mounting clip 20 may be removably attached by affixing it to the putter with "VELCRO" or the like. This removable configuration provides the user with an opportunity to practice the putting stroke using the training device of the invention, and then remove the training device prior to making the final putt.

The flexible nature of the bracket 14 permits the bracket 14 to be held within the clip 20 by tension. When mounted, the bracket 14 is placed under tension between the fingers 22 and the clip 20, thus holding the bracket-and roller in place. The bracket 14 is removed by overcoming the tension provided by the fingers 22 and sliding the bracket 14 out of the mounting clip 20.

In use, a perfectly aligned, perpendicular putting stroke will result in minimal friction generated between the roller 18 and the inside surface 15 of the bracket 14 or washer 28 as the roller 18 rolls along the ground. Any deviation or misalignment from a perfectly perpendicular stroke will result in the generation of friction by the roller 18 as the roller drags along the ground. In addition, a misaligned putt causes the end of the roller to make contact with the washer or bracket, thus resulting in further frictional feedback. The friction generated by the roller and bracket is transmitted up the shaft and can be felt by the user. The user will subsequently adjust the stroke or hand position on the club to correct for the misalignment. The training device is versatile so that it may be used on the golf course, or in the home.

The invention offers the additional psychological advantage that when the training device 12 is in use, it cannot be seen by the user during the putting stroke because the top of the club head covers the device. Accordingly, when the device 12 is removed, the appearance of the club head is unchanged and the psychological effect of putting without the device is alleviated.

Although the bracket 14 is illustrated and described as being removable from the bottom surface of the club head, it will be appreciated that an embodiment comprising the bracket and roller assembly 12 permanently attached to the mounting clip 20 may also be implemented.

Although the invention has been shown and described with respect to an illustrative embodiment thereof, it should be appreciated that the foregoing and various other changes, omissions, and additions in the form and detail thereof may be made without departing from the spirit and scope of the invention as delineated in the claims.

I claim:

1. A golf putter, comprising:

a putter head having a bottom surface;

a clip attachable to said bottom surface of said putter head, said clip including at least one finger forming an expandable opening;

a generally U-shaped resilient bracket comprising a cylindrical roller mounted between downwardly extending arms of said U-shaped bracket, said bracket removably insertable within said expandable opening of said clip;

wherein said cylindrical roller mounted in said bracket provides directional feedback to a user to indicate a misaligned putt during a putting stroke.

2. The golf putter of claim 1, wherein said generally U-shaped resilient bracket comprises spring steel.

3. The golf putter of claim 1, wherein said generally U-shaped resilient bracket comprises plastic.

4. The golf putter of claim 1, further including a washer mounted between each end of said roller and said downwardly extending arms of said U-shaped bracket.

5. The golf putter of claim 1, wherein said roller includes a polymer coating on each end, said polymer coating providing increased frictional feedback during a putting stroke.

6. The golf putter of claim 1, wherein said clip is attached to said bottom surface of said putter by an adhesive.

7. The golf putter of claim 1, wherein said clip is attached to said bottom surface of said putter by double sided tape.

8. The golf putter of claim 1, wherein said clip is attached to said bottom surface of said putter by interlocking fibers.

9. A golf putter, comprising:

a putter head having a bottom surface;

a clip attached to said bottom surface of said putter head, said clip including two fingers forming an expandable opening; and a generally U-shaped resilient bracket removably insertable within said expandable opening and having downwardly extending arms and comprising a cylindrical roller mounted between said downwardly extending arms of said bracket, the ends of said roller having a polymer coating; and a washer disposed between each of said downwardly extending arms and said ends of said roller;

wherein said cylindrical roller mounted in said bracket provides frictional feedback to a user to indicate a misaligned putt during a putting stroke.

* * * * *